US009265129B2

(12) United States Patent
Lai

(10) Patent No.: US 9,265,129 B2
(45) Date of Patent: Feb. 16, 2016

(54) ADAPTER CABLE HAVING LIGHT SOURCE FOR LIGHTING

(71) Applicant: HON HAI PRECISION INDUSTRY CO., LTD., New Taipei (TW)

(72) Inventor: Chih-Chen Lai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 224 days.

(21) Appl. No.: 13/968,393

(22) Filed: Aug. 15, 2013

(65) Prior Publication Data

US 2014/0285119 A1 Sep. 25, 2014

(30) Foreign Application Priority Data

Mar. 22, 2013 (TW) ..... 102110154 U

(51) Int. Cl.
*H05B 37/02* (2006.01)
*H05B 41/10* (2006.01)

(52) U.S. Cl.
CPC ..... *H05B 37/0245* (2013.01); *H05B 37/02* (2013.01); *H05B 37/0209* (2013.01); *H05B 41/10* (2013.01)

(58) Field of Classification Search
CPC .. H05B 7/0245; H05B 37/02; H05B 37/0209; H05B 37/00; H05B 41/10
See application file for complete search history.

(56) References Cited

U.S. PATENT DOCUMENTS

| | | | | |
|---|---|---|---|---|
| 8,562,165 | B2 * | 10/2013 | Thompson et al. | 362/103 |
| 2009/0261737 | A1 * | 10/2009 | Wright et al. | 315/154 |
| 2013/0167226 | A1 * | 6/2013 | Lin | 726/19 |
| 2013/0300318 | A1 * | 11/2013 | Kim et al. | 315/313 |
| 2014/0111449 | A1 * | 4/2014 | Lee | 345/173 |

* cited by examiner

*Primary Examiner* — Jung Kim
(74) *Attorney, Agent, or Firm* — Novak Druce Connolly Bove + Quigg LLP

(57) ABSTRACT

An adapter cable includes a first adapter, a second adapter, and a wire. The first adapter includes a sensor, a light source, and a processor. The sensor generates a detecting signal when sensing that the first adapter is picked up. The processor is connected between the sensor and the light source. The processor turns on the light source when receiving the detecting signal output from the sensor. The wire is connected between the first adapter and the second adapter.

7 Claims, 2 Drawing Sheets

ADAPTER CABLE HAVING LIGHT SOURCE FOR LIGHTING

BACKGROUND

1. Technical Field

The present disclosure relates to adapter cables and, particularly, to an adapter cable having a light source for lighting.

2. Description of Related Art

Adapter cables generally include two adapters and a wire connected between the two adapters. When the adapter cable is used to connect between two ports of two electrical devices in a dark environment, it is hard to find the ports.

Therefore, it is desirable to provide an adapter cable, which can overcome the limitations described.

DETAILED DESCRIPTION

Embodiments of the disclosure will be described with reference to the drawings.

Figure 1:
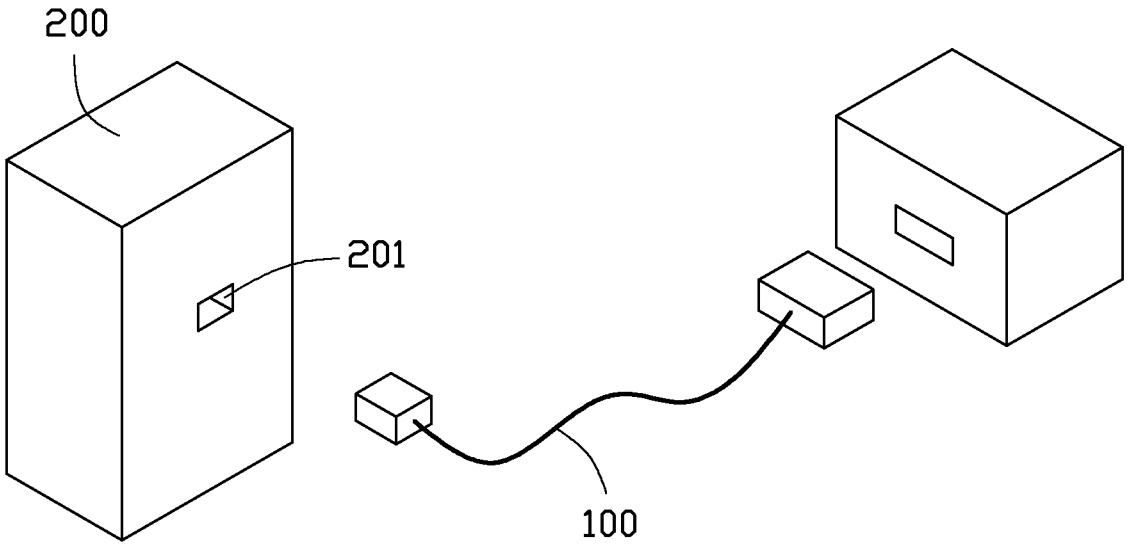
FIG. 1 is an isometric view of an adapter cable in accordance with an exemplary embodiment.
Figure 2:
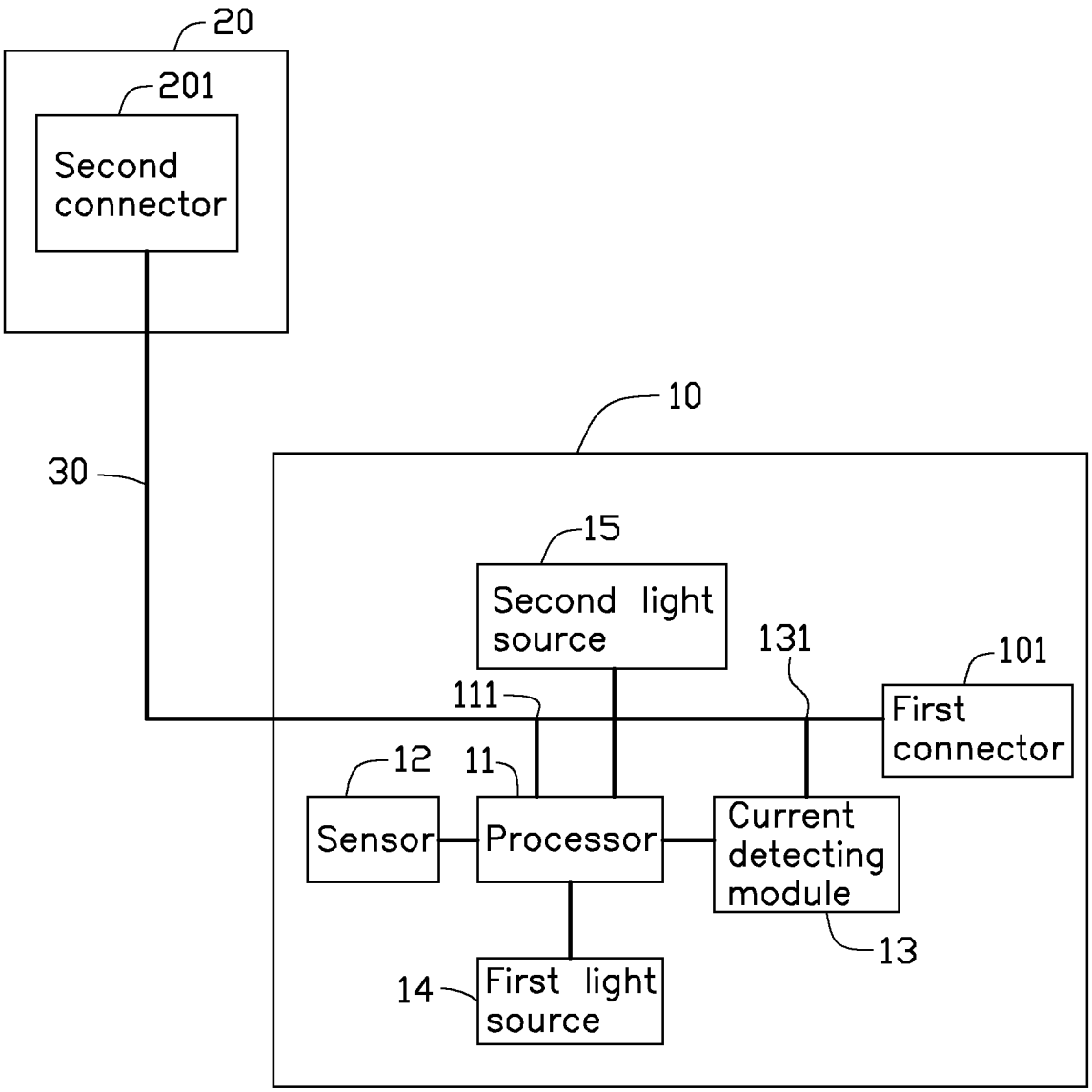
FIG. 2 is a functional block diagram of the adapter cable of FIG. 1.

FIGS. 1-2 show an adapter cable 100 according to an exemplary embodiment. The adapter cable 100 is used to connect between two electrical devices 200. Each of the electrical devices 200 has a port 201. The adapter cable 100 is connected between the two ports 201. In the embodiment, one of the electrical devices 200 is a mobile phone, and another electrical device 200 is a computer.

The adapter cable 100 includes a first adapter 10, a second adapter 20, and a wire 30 connected between the first adapters 10 and the second adapter 20. A type of the first adapter 10 can be the same as or different from a type of the second adapter 20. In the embodiment, the first adapter 10 is a USB, and the second adapter 20 is a micro-USB.

The first adapter 10 includes a first connector 101, and the second adapter 20 includes a second connector 201. The first connector 101 and the second connector 201 are respectively electrically connected to two ends of the wire 30. The first adapter 10 includes a processor 11, a sensor 12, a current detecting module 13, a first light source 14, and a second light source 15.

The processor 11 executes preset orders according to prestored programs stored in a memory (not shown). The processor 11 is electrically connected to the wire 30 at a first connecting point 111. The processor 11 is supplied power source via the wire 30. In other embodiment, the first adapter 10 includes a built-in power supply (not shown) electrically connected to the processor 11.

The sensor 12 is electrically connected to the processor 11, and is configured for detecting whether or not the first adapter 10 is picked up by a user. When the sensor 12 detects that the first adapter 10 is picked up by the user, the sensor 12 outputs a detecting signal to the processor 11. In the embodiment, the sensor 12 is an electromagnetic induction coil, the electromagnetic induction coil generates a current when detecting of electrostatic charges of the user. It should be understood, the sensor 12 can be a pressure sensor or an inductive proximity switch.

The current detecting module 13 is electrically connected to the wire 30 at a second connecting point 131. The second connecting point 131 is adjacent to the first connector 101 of the first adapter 10 relative to the first connecting point 111. The current detecting module 13 is configured for detecting current flowing to the first adapter 10. As the second connecting point 131 is adjacent to the first connector 101 relative to the first connecting point 111, the current detecting module 13 will not detect the current flowing to the first adapter 10 if the first connector 101 is not connected to the port 201 of the electrical device 200. The current detecting module 13 is electrically connected to the processor 11, the processor 11 controls the current detecting module 13 to detect the current after receiving the detecting signal.

The first light source 14 and the second light source 15 are respectively electrically connected to the processor 11. The first light source 14 is configured for lighting. The second light source 15 is configured for indicating a current intensity of current outputting to the first adapter 10. In the embodiment, the first light source 14 and the second light source 15 are light emitting diodes (LEDs), and respectively emit different color light rays.

The wire 30 is a signal line or a data line. In the embodiment, the wire 20 is made of copper.

In use, when the adapter cable 100 is used to connect between the two electrical devices 200, first, the second connector 201 of the second adapter 20 is connected to the port 201 of one electrical device 200. This electrical device 200 supplies power source to the processor 11 of the first adapter 10 via the wire 30. When the user picks up the first adapter 10, the sensor 12 outputs the detecting signal to the processor 11. The processor 11 turns on the first light source 14 when receiving the detecting signal. The user finds a position of the port 201 of the other electrical device 200 under the help of the light rays emitted from the first light source 14, and connects the first connector 101 of the first adapter 10 to the port 201 of the electrical device 200.

When the processor 11 receives the detecting signal, and then controls the current detecting module 13 to detect the current flowing to the first adapter 10. The current detecting module 13 outputs a value of the current to the processor 11. The processor 11 controls a luminance of the second light source 15 according to the value of the current. The greater the value of the current is, the higher the luminance is.

Particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. An adapter cable, comprising:

a first adapter comprising:

a sensor configured for generating a detecting signal when sensing that the first adapter is picked up;

a first light source; and a processor connected between the sensor and the first light source, the processor turning on the first light source when receiving the detecting signal output from the sensor;

a second adapter; and a wire connected between the first adapter and the second adapter;

wherein the sensor generates the detecting signal on the condition that the sensor senses that the first adapter is held by a user, and the sensor is selected from one of the group consisting of an electromagnetic induction coil, a pressure sensor, and an inductive proximity switch.

2. The adapter cable of claim 1, wherein the first adapter comprises a first connector, and the second adapter comprises a second connector, the first connector and the second connector are electrically connected to two ends of the wire.

3. The adapter cable of claim 1, wherein the first adapter comprises a current detecting module and a second light source, the current detecting module and the second light source are connected to the processor, the current detecting module is connected to the wire.

4. The adapter cable of claim 3, wherein the processor controls a luminance of the second light source according to a value of the current detected by the current detecting module.

5. The adapter cable of claim 4, wherein the first light source and the second light source are LEDs, and respectively emit different color light rays.

6. The adapter cable of claim 1, wherein a type of the first adapter is different from a type of the second adapter.

7. The adapter cable of claim 1, wherein the first adapter is a USB, and the second adapter is a micro-USB.

* * * * *